US008567413B2

(12) United States Patent
Lane

(10) Patent No.: US 8,567,413 B2
(45) Date of Patent: Oct. 29, 2013

(54) HAIR ADDITION FOR PROVIDING BUMP UP EFFECT

(75) Inventor: Teresa Lane, Hallendale Beach, FL (US)

(73) Assignee: Celebrity Signature International, Inc., Kansas City, MO (US)

( * ) Notice: Subject to any disclaimer, the term of this patent is extended or adjusted under 35 U.S.C. 154(b) by 37 days.

(21) Appl. No.: 12/767,345

(22) Filed: Apr. 26, 2010

(65) Prior Publication Data

US 2010/0313902 A1 Dec. 16, 2010

Related U.S. Application Data

(60) Provisional application No. 61/185,862, filed on Jun. 10, 2009.

(51) Int. Cl.

| | |
|---|---|
| ***A41G 3/00*** | (2006.01) |
| ***A41G 5/00*** | (2006.01) |
| ***A45D 8/38*** | (2006.01) |

(52) U.S. Cl.

USPC ..... 132/53; 132/54; 132/105; 132/106

(58) Field of Classification Search

USPC ..... 132/53–56, 201, 105, 106, 107, 274, 132/276, 128, 273, 275, 278, 246; 446/394; 623/15.11; 606/187; 434/94, 377

See application file for complete search history.

(56) References Cited

U.S. PATENT DOCUMENTS

| | | | | |
|---|---|---|---|---|
| 650,959 A | | 11/1897 | Barrett | |
| 606,728 A | | 7/1898 | May | |
| 3,434,481 A | * | 3/1969 | Mazzocco | 132/53 |
| 3,435,832 A | | 4/1969 | Ito | |
| 3,444,865 A | * | 5/1969 | De Vita | 132/53 |
| 3,452,761 A | * | 7/1969 | Irving | 132/106 |
| 3,645,279 A | * | 2/1972 | Imre | 132/53 |
| 3,659,621 A | * | 5/1972 | Tucciarone et al. | 132/53 |
| 3,734,105 A | * | 5/1973 | Borghese | 132/53 |

(Continued)

FOREIGN PATENT DOCUMENTS

| | | | |
|---|---|---|---|
| JP | 02571940 | Y2 | 2/1998 |
| KR | 20-0251945 | Y1 | 11/2001 |
| KR | 10-0460836 | B1 | 12/2004 |
| KR | 10-2005-0102707 | A | 10/2005 |

OTHER PUBLICATIONS

International Search Report and Written Opinion issued in related PCT Patent Application Serial No. PCT/US2010/037957, dated Dec. 29, 2010.

*Primary Examiner* — Vanitha Elgart

(74) *Attorney, Agent, or Firm* — Lathrop & Gage LLP

(57) ABSTRACT

Devices having real or synthetic hair that are worn on a user's head to complement, accent, or otherwise alter the appearance of the user's hair are disclosed. According to one embodiment, a hair addition for providing a bump up effect includes a foundation, a plurality of attachment members coupled to the foundation for attaching the foundation to a wearer's hair, a plurality of hair strand retention members spanning the foundation, and a plurality of hair strands coupled to the hair strand retention members and collectively concealing the foundation, the attachment members, and the hair strand retention members. The foundation has an outer frame and a plurality of shaping strips. The outer frame defines front and rear sides and opposed ends. The shaping strips extend from the front side to the rear side, and each shaping strip is bendable and retains its form until further manipulated.

21 Claims, 5 Drawing Sheets

(56) References Cited

U.S. PATENT DOCUMENTS

| | | | | | |
|---|---|---|---|---|---|
| 3,777,768 | A * | 12/1973 | Scigliano | 132/53 |
| 3,788,332 | A * | 1/1974 | Abbott et al. | 132/54 |
| 3,830,245 | A * | 8/1974 | Abbott et al. | 132/201 |
| 3,835,867 | A * | 9/1974 | Molinario | 132/201 |
| 3,868,959 | A * | 3/1975 | Koh | 132/53 |
| 4,155,370 | A * | 5/1979 | Nemoto | 132/53 |
| 4,168,713 | A * | 9/1979 | Agiotis | 132/53 |
| 4,171,001 | A * | 10/1979 | Leonard et al. | 132/53 |
| 4,576,189 | A * | 3/1986 | Regina | 132/53 |
| 4,949,737 | A | 8/1990 | Nakamura et al. | |
| 5,406,971 | A | 4/1995 | Taylor | |
| 5,687,750 | A | 11/1997 | Belmonte et al. | |
| 5,765,571 | A * | 6/1998 | Dinnel | 132/210 |
| 5,988,177 | A | 11/1999 | Bate | |
| 6,352,079 | B1 | 3/2002 | Bate | |
| 6,513,535 | B1 | 2/2003 | Lane | |
| 6,561,197 | B2 * | 5/2003 | Harrison | 132/201 |
| 6,629,536 | B1 | 10/2003 | Lane | |
| 6,691,714 | B1 | 2/2004 | Yaguchi et al. | |
| 7,150,282 | B2 | 12/2006 | Lane | |
| 7,174,899 | B2 | 2/2007 | Lane | |
| 7,174,900 | B2 | 2/2007 | Lane et al. | |
| 7,264,003 | B2 | 9/2007 | Chayeb | |
| 7,278,432 | B2 | 10/2007 | Lane | |
| 7,735,495 | B2 | 6/2010 | Lane et al. | |
| 2003/0140934 | A1 * | 7/2003 | Sugai et al. | 132/53 |
| 2004/0079382 | A1 * | 4/2004 | Profitt-Campbell | 132/201 |
| 2005/0051186 | A1 | 3/2005 | Smith et al. | |
| 2005/0194015 | A1 * | 9/2005 | Watts | 132/53 |
| 2005/0268928 | A1 | 12/2005 | Lane | |
| 2007/0012329 | A1 | 1/2007 | Lane | |
| 2007/0034221 | A1 * | 2/2007 | Chung | 132/53 |
| 2007/0131236 | A1 * | 6/2007 | Wakisaka | 132/53 |
| 2007/0157941 | A1 * | 7/2007 | Awad et al. | 132/53 |
| 2007/0221240 | A1 * | 9/2007 | Junsuh Lee | 132/201 |
| 2008/0178902 | A1 * | 7/2008 | Moeszinger | 132/273 |
| 2008/0257369 | A1 * | 10/2008 | Poole | 132/53 |
| 2009/0071490 | A1 * | 3/2009 | Sthair | 132/105 |
| 2009/0188512 | A1 * | 7/2009 | Eaton | 132/54 |
| 2009/0235948 | A1 * | 9/2009 | Zephyr et al. | 132/201 |
| 2010/0170527 | A1 * | 7/2010 | Toba | 132/201 |
| 2010/0192965 | A1 * | 8/2010 | Kang | 132/54 |
| 2010/0326455 | A1 * | 12/2010 | Karsenti et al. | 132/53 |
| 2011/0005544 | A1 * | 1/2011 | Lane | 132/201 |
| 2011/0023902 | A1 * | 2/2011 | Cho | 132/53 |
| 2011/0023903 | A1 * | 2/2011 | Kezios | 132/201 |
| 2011/0036368 | A1 * | 2/2011 | Park | 132/54 |
| 2011/0180091 | A1 * | 7/2011 | Wilson | 132/201 |
| 2011/0253165 | A1 * | 10/2011 | Kenna | 132/273 |

* cited by examiner

HAIR ADDITION FOR PROVIDING BUMP UP EFFECT

RELATED APPLICATIONS

This application claims priority to U.S. Provisional Patent Application Ser. No. 61/185,862, filed Jun. 10, 2009, the disclosure of which is incorporated herein by reference.

TECHNICAL FIELD

The disclosed subject matter is directed to hair additions, which are devices having real or synthetic hair that are worn on a user's head to complement, accent, or otherwise alter the appearance of the user's hair.

BACKGROUND

"Bumped" hair styles are popular among women. However, achieving this effect is generally difficult and time consuming, and the effect often lasts for less time than desired. Conventional solutions, such as that disclosed in U.S. Pat. No. 7,264,003, involve providing a foundation device that the user's hair must either lay over or be intertwined with to cover.

BRIEF SUMMARY

According to one embodiment, a hair addition for providing a bump up effect includes a foundation, a plurality of attachment members coupled to the foundation for attaching the foundation to a wearer's hair, a plurality of hair strand retention members spanning the foundation, and a plurality of hair strands coupled to the hair strand retention members and collectively concealing the foundation, the attachment members, and the hair strand retention members. The foundation has an outer frame and a plurality of shaping strips. The outer frame defines front and rear sides and opposed ends. The shaping strips extend from the front side to the rear side, and each shaping strip is bendable and retains its form until further manipulated.

According to another embodiment, a hair addition for providing a bump up effect includes a foundation, means for attaching the foundation to a wearer's hair, a plurality of hair strand retention members spanning the foundation, and a plurality of hair strands coupled to the hair strand retention members and collectively concealing the foundation, the attachment members, and the hair strand retention members. The foundation has an outer frame and a plurality of shaping strips. The outer frame defines front and rear sides and opposed ends. The shaping strips extend from the front side to the rear side, and each shaping strip is bendable and retains its form until further manipulated.

DETAILED DESCRIPTION

Figure 1:
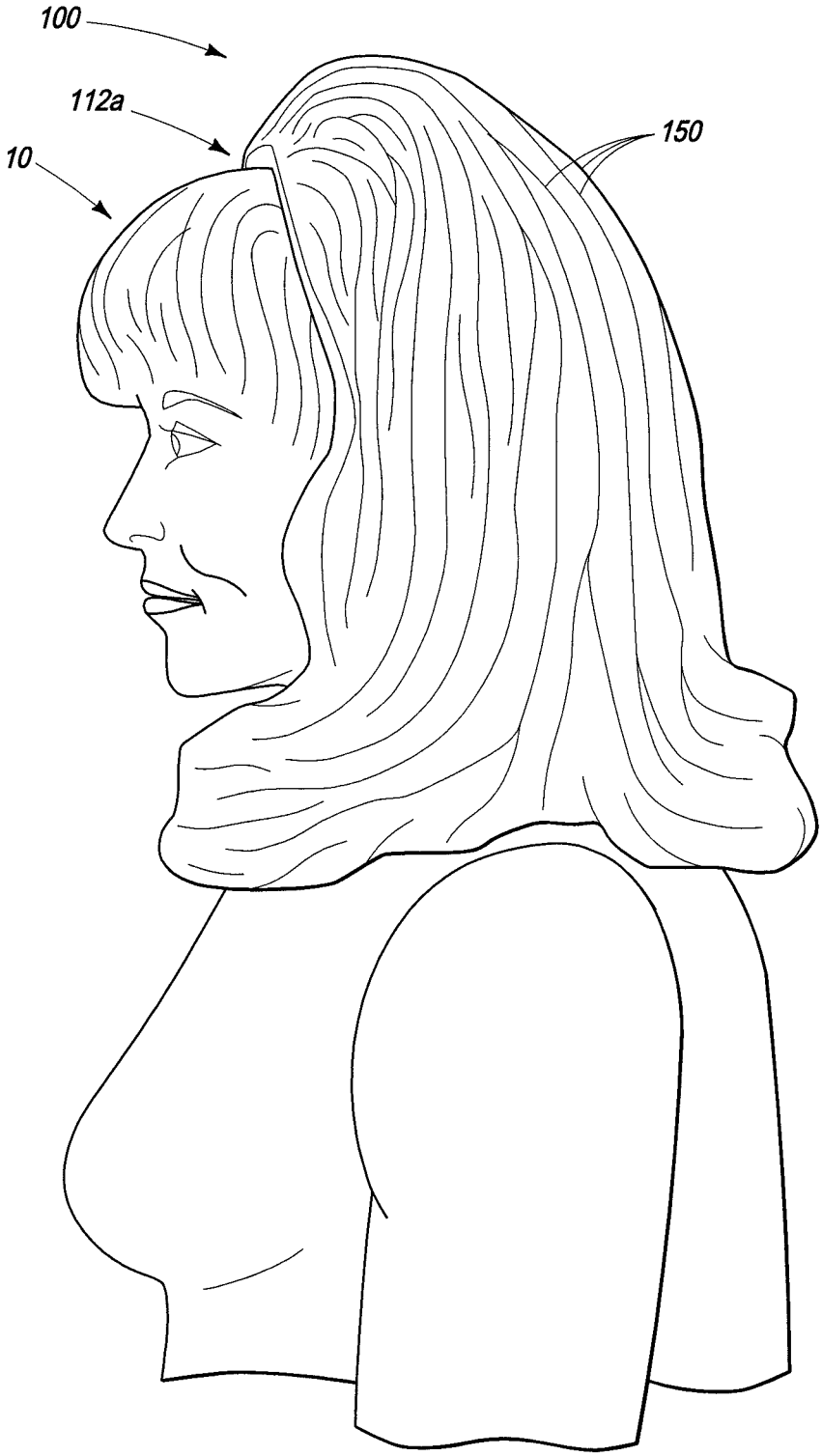
FIG. 1 shows a hair addition according to an embodiment set forth herein, in use.

FIGS. 1 through 6 show a hair addition 100 that provides a bump up effect when worn on a wearer's head 10 (FIG. 1) according to one embodiment. The hair addition 100 includes a foundation 110, attachment members 130, hair strand retention members 140, and hair strands 150.

Figure 2:
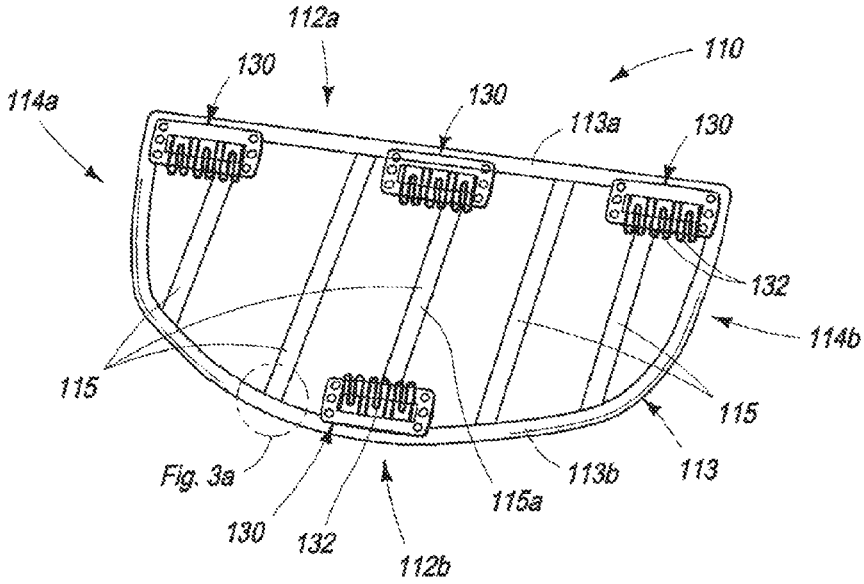
FIG. 2 shows the foundation and the attachment members of the hair addition of FIG. 1.

The foundation 110, best shown in FIG. 2, has a front side 112*a*, a rear side 112*b*, and opposed ends 114*a*, 114*b* defined by an outer frame 113. The outer frame 113 may be constructed of one or more piece of material, and two pieces 113*a* (defining the front side 112*a*) and 113*b* (defining the opposed ends 114*a*, 114*b* and the rear side 112*b*) are shown in FIG. 2. Pieces 113*a*, 113*b* may, for example, be strips of non-elastic lace having a width of approximately 3/16 inch to approximately ¼ inch. It should be appreciated that other materials and sizes may also be appropriate, however.

Figure 7:
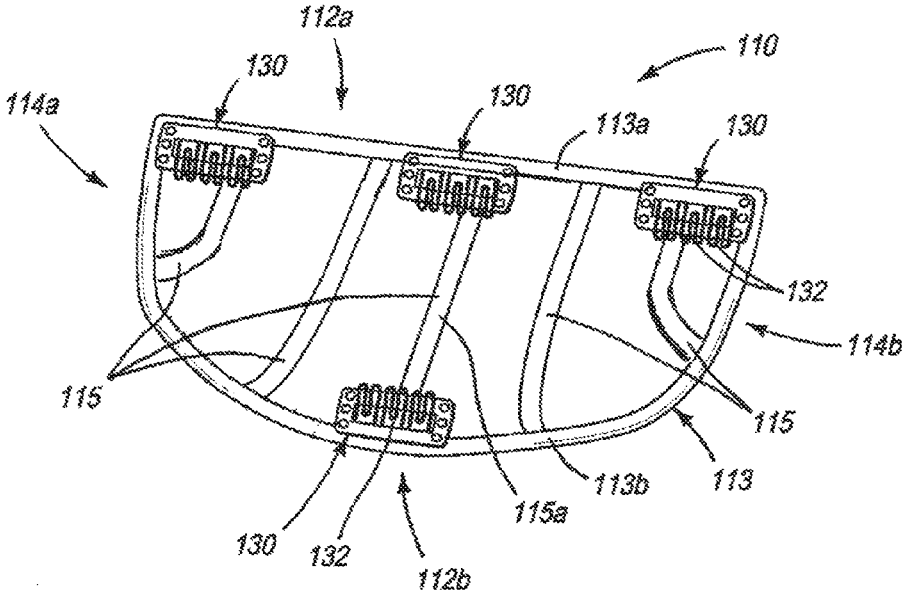
FIG. 7 shows the foundation according to another embodiment.

Shaping strips 115 in the foundation 110 extend across the outer frame 113 from the front side 112*a* to the rear side 112*b* and may be generally linear and parallel (as shown in FIG. 2) or may be, as shown in FIG. 7 for example, arcuate such that the shaping strips 115 on each side of a central shaping strip 115*a* attach to the rear side 112*b* further away from the central shaping strip 115*a* than is shown in FIG. 2. Each shaping strip 115 is bendable but retains its form until further manipulated.

Figure 3A:
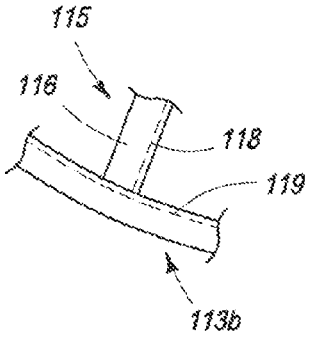
FIG. 3*a* shows a portion of FIG. 2 in detail.
Figure 3B:
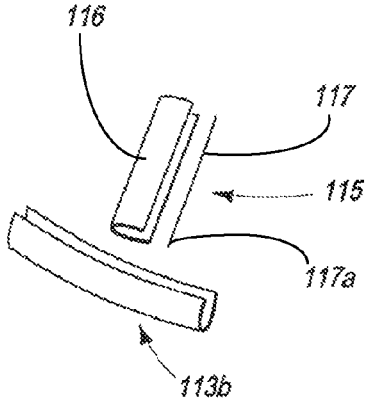
FIG. 3*b* shows an exploded view of FIG. 3*a*.
Figure 8A:
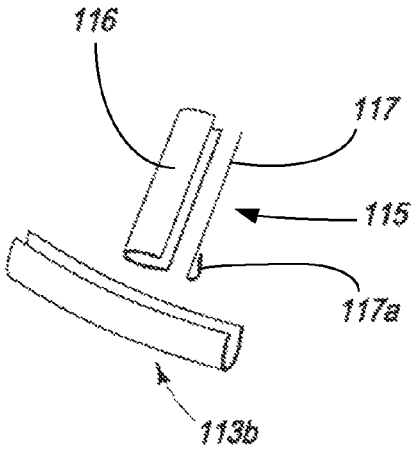
FIG. 8*a* shows an exploded view of the portion of FIG. 2, according to another embodiment.
Figure 8B:
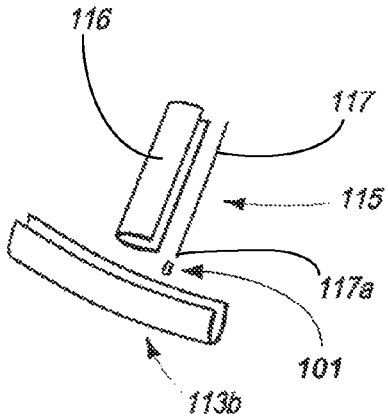
FIG. 8*b* shows an exploded view of the portion of FIG. 2, according to still another embodiment.

In some embodiments, as shown in FIGS. 3*a* and 3*b*, each shaping strip 115 may include an elongate strip of material 116 (e.g., non-elastic lace) folded around a wire 117 and stitched together by stitching 118 such that the material 116 envelops the wire 117. The material 116 in some embodiment has a width once folded of approximately 3/16 inch to approximately ¼ inch, though other sizes may also be appropriate. The wire 117 may be one or more strand of metal, composite, or other bendable material of any dimension so long as the wire 117 fits inside the folded material 116, may be repeatedly bent without breaking, and retains its form until further manipulated. The material 113*b* may be folded similar to the material 116 and stitched by stitching 119, and the material 113*b* may envelop the material 116 and an end 117*a* of the wire 117. In some embodiments, the end 117*a* is bent (FIG. 8*a*) and/or covered (FIG. 8*b*) by a covering 101 (e.g., by a cap, adhesive or sealant that this then dried/cured, etc.) to further secure the end 117*a*.

Returning to FIG. 2, the attachment members 130 may be any appropriate hair engaging members. Exemplary hair engagement members (typically identified by reference number 12) are illustrated and described in detail in U.S. Patent Application Publication Number 2007/0221244 (Lane), assigned to Celebrity Signatures International, Inc., the contents of which are hereby incorporated by reference. As shown in FIG. 2, three attachment members 130 having teeth 132 may be coupled to the front side 112*a* of the foundation 110 and one attachment member 130 having teeth 132 may be coupled to the rear side 112*b* of the foundation 110, or other numbers and configurations of attachment members 130 may be used. It may be advantageous for the teeth 132 of the attachment members 130 coupled to the front side 112*a* to face the rear side 112*b* and for the teeth 132 of the attachment member(s) 130 coupled to the rear side 112*b* to face the front side 112*a*, as shown in FIG. 2.

Figure 4:
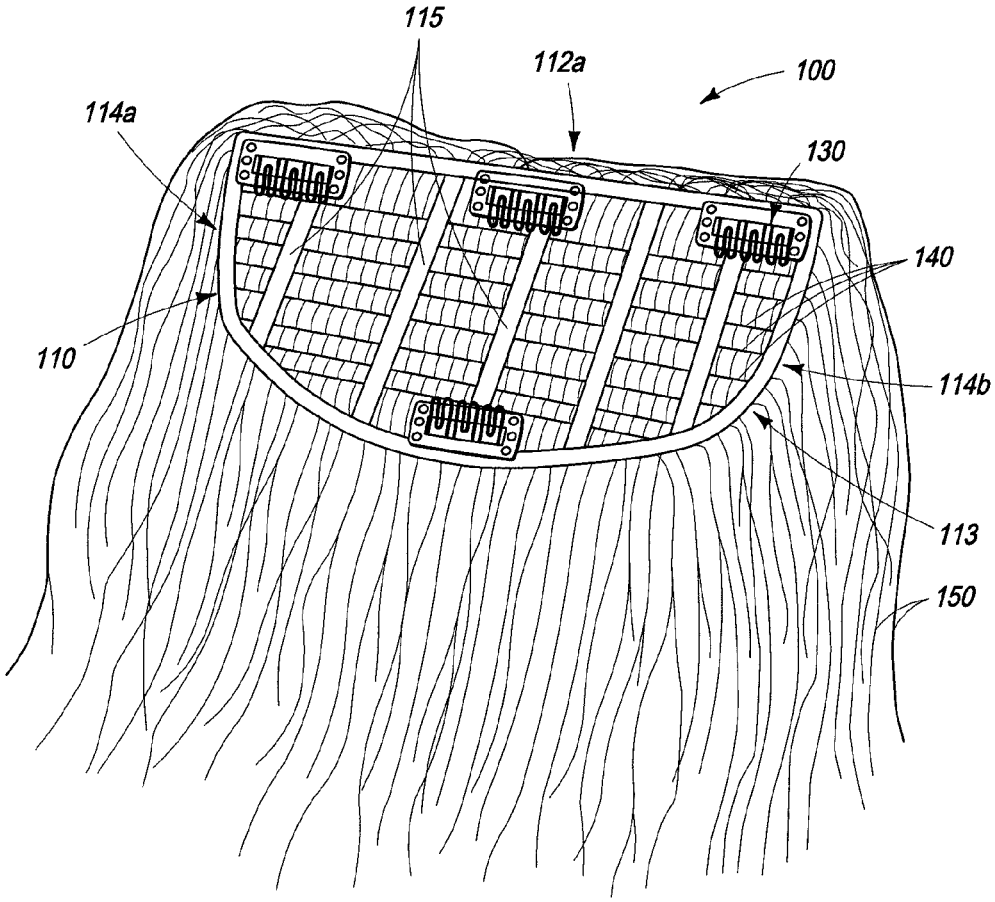
FIG. 4 shows the underside of the hair addition of FIG. 1, in an unbent configuration.

Turning now to FIG. 4, the hair strand retention members 140 may extend across the foundation 110, and specifically across the outer frame 113, and may be connected (e.g., stitched, adhered, etc.) to the outer frame 113 and the shaping strips 115. In addition, a netting (e.g., a honeycomb netting; not shown in the drawings) may extend across the outer frame 113, and the hair strand retention members 140 may also be connected to the netting. In one embodiment, the hair strand retention members 140 are formed utilizing a stitching pattern such that they engage and retain in place the hair strands 150 inserted into the hair strand retention members 140 as a segment of the hair strand retention 140 manufacturing process. Certain hair strand retention members 140 may be longer than others due to the varying distances between the ends 114*a*, 114*b*, as can be seen in FIG. 4.

Figure 5:
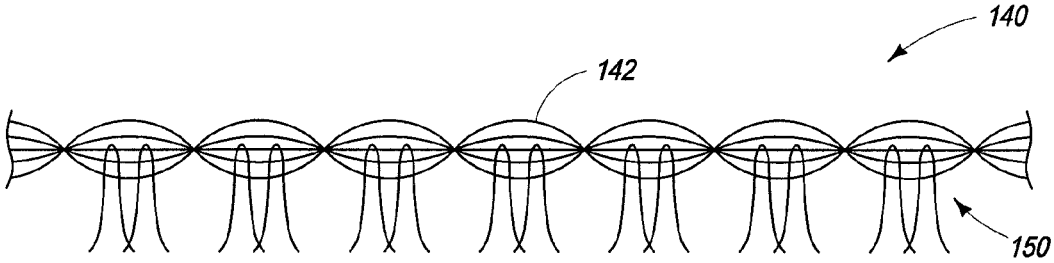
FIG. 5 shows a segment of a hair strand retention member and hair strands of the hair addition of FIG. 1.

FIG. 5 illustrates one segment of a respective hair strand retention member 140 that includes hair strands 150 retained therein. For clarity, FIG. 5 illustrates hair strands 150 in a less dense pattern than would be utilized in a typical product. As illustrated, hair strand retention members 140 are formed as a stitched pattern of individual threads 142 that engage a substantial midpoint of respective hair strands 150. In other words, the hair strands 150 are folded approximately in half and the pattern of individual threads 142 engages the hair strands 150 at the fold. In one embodiment, respective hair strands 150 are individually stitched into hair strand retention members 140. In an alternative embodiment, bundles of hair strands 150, ranging from five to two hundred individual hair strands per bundle, are stitched into hair strand retention members 140. Spacing between individual hair strands 150, or alternatively bundles of hair strands 150, is dependent on the density desired for the hair addition 100.

The hair strands 150 may be of any configuration depending on the hair style desired for the hair addition 100. As a result, a user can utilize the addition of hair strands 150 to the user's natural hair to provide various hair styles, some of which may not be attainable, or desirable in appearance, without the hair addition 100. More specifically, in various embodiments, the hair strands 150 may be arcuate, tightly curled, or substantially straight, and of varying lengths and colors. In addition, the hair strands 150 may include one or more of synthetic hair strands or natural hair strands. For synthetic hair strands, the hair may be fabricated from a polymer fiber such as modacrylic, or the synthetic hair may be fabricated from a polymer fiber other than modacrylic, such as, for example, acrylic.

Figure 6:
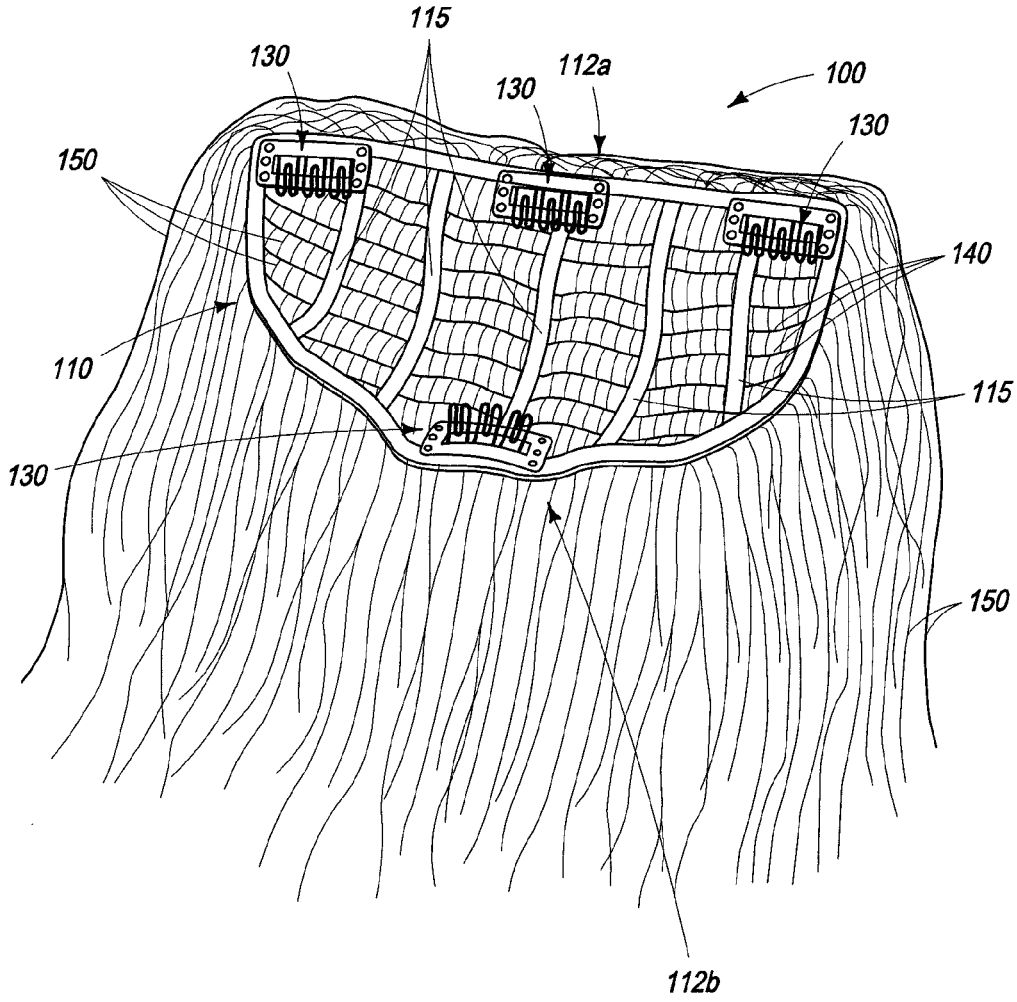
FIG. 6 shows the underside of the hair addition of FIG. 1, in a bent configuration.

FIG. 6 shows the hair addition 100 bent in preparation for use, with the shaping strips 115 bent such that the front side 112*a* of the foundation 110 is maintained closer to the rear side 112*b* of the foundation 110 to form a bumped or raised effect when the attachment members 130 are fastened to the wearer's hair (FIG. 1). In one manner of use, the shaping strips 115 are bent prior to any of the attachment members 130 being fastened to the wearer's hair, the attachment members 130 at the front side 112*a* of the foundation 110 are fastened to the wearer's hair, the shaping strips 115 are further bent to achieve the desired style, and the attachment member 130 at the rear side 112*b* of the foundation 110 is fastened to the wearer's hair. The wearer's hair may then be blended in with the hair addition 100 as desired, though minimal blending should be needed. The flexibility and stability provided by the shaping strips may allow a single hair addition 100 to properly fit heads of various shapes and sizes, and may also allow different bumped looks (e.g., bumps of different heights and configurations) to be created even on a single user.

Those skilled in the art appreciate that variations from the specified embodiments disclosed above are contemplated herein and that the described embodiments are not limiting. The description should not be restricted to the above embodiments, but should be measured by the following claims.

I claim:

1. A hair addition for providing a bump up effect, comprising:

a foundation having an outer frame and a plurality of shaping strips, the outer frame defining front and rear sides and opposed ends, the shaping strips extending from the front side to the rear side, each shaping strip being bendable and retaining its form until further manipulated;

a plurality of attachment members coupled to the foundation for attaching the foundation to a wearer's hair;

a plurality of hair strand retention members spanning the outer frame opposed ends; and a plurality of hair strands coupled to the hair strand retention members and collectively concealing the foundation, the attachment members, and the hair strand retention members;

wherein a respective shaping strip includes an elongate strip of material folded around a wire and fastened together such that the material envelops the wire;

wherein the outer frame includes at least one elongate piece of non-rigid outer frame material folded around an end of the shaping strip having the elongate strip of material folded around the wire.

2. The hair addition of claim 1, wherein an end of the wire is bent.

3. The hair addition of claim 1, wherein an end of the wire is covered by at least one item selected from the group consisting of: a cap, adhesive, and sealant.

4. The hair addition of claim 1, wherein the plurality of shaping strips are generally parallel to one another.

5. The hair addition of claim 4, wherein:

at least one of the attachment members is coupled to the foundation at the foundation front side and includes teeth facing the foundation rear side; and at least one of the attachment members is coupled to the foundation at the foundation rear side and includes teeth facing the foundation front side.

6. The hair addition of claim 1, wherein the plurality of shaping strips are closer together at the outer frame front side than at the outer frame rear side.

7. The hair addition of claim 6, wherein an end of the wire is at least one of:

(a) bent;

(b) covered by a cap;

(c) covered by adhesive; and (d) covered by sealant.

8. The hair addition of claim 6, wherein:

at least one of the attachment members is coupled to the foundation at the foundation front side and includes teeth facing the foundation rear side; and at least one of the attachment members is coupled to the foundation at the foundation rear side and includes teeth facing the foundation front side.

9. The hair addition of claim 6, wherein:

one of the attachment members is coupled to the foundation adjacent one of the outer frame ends at the foundation front side and includes teeth facing the foundation rear side;

one of the attachment members is coupled to the foundation adjacent the other outer frame end at the foundation front side and includes teeth facing the foundation rear side; and at least one of the attachment members is coupled to the foundation at the foundation rear side and includes teeth facing the foundation front side.

10. The hair addition of claim 9, wherein one of the attachment members is generally centered along and coupled to the foundation front side and includes teeth facing the foundation rear side.

11. The hair addition of claim 10, wherein the rear side and opposed ends of the outer frame are collectively generally arcuate.

12. A hair addition for providing a bump up effect, comprising:

a foundation having an outer frame and a plurality of shaping strips, the outer frame defining front and rear sides and opposed ends and consisting essentially of fabric, the shaping strips extending from the front side to the rear side, each shaping strip being bendable and retaining its form until further manipulated;

means for attaching the foundation to a wearer's hair;

a plurality of hair strand retention members spanning the outer frame; and a plurality of hair strands coupled to the hair strand retention members and collectively concealing the foundation, the attachment members, and the hair strand retention members;

wherein a respective shaping strip includes an elongate strip of material folded around a wire and fastened together such that the material envelops the wire; and wherein the outer frame includes at least one elongate piece of non-rigid outer frame material folded around an end of the shaping strip having the elongate strip of material folded around the wire.

13. The hair addition of claim 12, wherein the plurality of shaping strips are generally parallel to one another.

14. The hair addition of claim 12, wherein the plurality of shaping strips are closer together at the outer frame front side than at the outer frame rear side.

15. A hair addition for providing a bump up effect, comprising:

a foundation having an outer frame and a plurality of shaping strips, the outer frame defining front and rear sides and opposed ends, the shaping strips extending from the front side to the rear side, each shaping strip being bendable and retaining its form until further manipulated;

means for attaching the foundation to a wearer's hair;

a plurality of hair strand retention members spanning the outer frame opposed ends; and a plurality of hair strands coupled to the hair strand retention members and collectively concealing the foundation, the attachment members, and the hair strand retention members;

wherein a respective shaping strip includes an elongate strip of material folded around a wire and fastened together such that the material envelops the wire;

wherein the outer frame includes at least one elongate piece of non-rigid outer frame material folded around an end of the shaping strip having the elongate strip of material folded around the wire.

16. The hair addition of claim 15, wherein an end of the wire is bent.

17. The hair addition of claim 15, wherein an end of the wire is covered by at least one item selected from the group consisting of: a cap, adhesive, and sealant.

18. The hair addition of claim 15, wherein the plurality of shaping strips are generally parallel to one another.

19. The hair addition of claim 15, wherein the plurality of shaping strips are closer together at the outer frame front side than at the outer frame rear side.

20. The hair addition of claim 19, wherein an end of the wire is at least one of:

(a) bent;

(b) covered by a cap;

(c) covered by adhesive; and (d) covered by sealant.

21. The hair addition of claim 15, wherein the rear side and opposed ends of the outer frame are collectively generally arcuate.

* * * * *